US008425203B2

(12) United States Patent
Gardner et al.

(10) Patent No.: US 8,425,203 B2
(45) Date of Patent: Apr. 23, 2013

(54) PORTABLE PRESSURE WASHER SYSTEM

(75) Inventors: Michael R. Gardner, Anderson, SC (US); Klaus K. Hahn, Braselton, GA (US); Lee Sowell, Pelzer, SC (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 973 days.

(21) Appl. No.: 12/429,551

(22) Filed: Apr. 24, 2009

(65) Prior Publication Data

US 2009/0269218 A1 Oct. 29, 2009

Related U.S. Application Data

(60) Provisional application No. 61/048,014, filed on Apr. 25, 2008.

(51) Int. Cl.
*F04B 53/00* (2006.01)

(52) U.S. Cl.
USPC ..... 417/234; 417/236

(58) Field of Classification Search ..... 417/223, 417/15, 34, 234, 319, 326, 364
See application file for complete search history.

(56) References Cited

U.S. PATENT DOCUMENTS

| | | | |
|---|---|---|---|
| 3,716,194 | A | 2/1973 | Miller |
| 3,904,116 | A | 9/1975 | Jones et al. |
| 4,197,872 | A | 4/1980 | Parker |
| 4,341,350 | A | 7/1982 | Wemmer |
| D270,368 | S | 8/1983 | Grime |
| 4,646,977 | A | 3/1987 | Iwamura et al. |
| D292,133 | S | 9/1987 | Proctor et al. |
| 4,792,096 | A | 12/1988 | Gregory |
| 4,824,340 | A | 4/1989 | Bruggeman et al. |
| 4,926,904 | A | 5/1990 | Polk et al. |
| 5,004,160 | A | 4/1991 | Berfield |
| 5,040,950 | A | 8/1991 | Dalquist, III et al. |
| 5,067,654 | A | 11/1991 | Paige |

(Continued)

FOREIGN PATENT DOCUMENTS

| | | |
|---|---|---|
| DE | 4115395 A1 | 11/1992 |
| DE | 9412004 U1 | 10/1994 |

(Continued)

OTHER PUBLICATIONS

U.S. Appl. No. 29/280,490, filed May 30, 2007, Hahn et al.

(Continued)

*Primary Examiner* — Karabi Guharay
*Assistant Examiner* — Elmito Breval
(74) *Attorney, Agent, or Firm* — Michael Best & Friedrich LLP

(57) ABSTRACT

A portable pressure washer system includes a frame having at least one strap configured such that the frame is supported by a user by way of the at least one strap. A torque generating device is supported by the frame and has an output shaft. A pump is selectively coupled to the output shaft to receive a torque generated by the torque generating device. The pump includes an inlet for connecting to a remote fluid source and an outlet for connecting to a high pressure fluid delivery mechanism. The pump receives a fluid from the remote fluid source by way of the inlet, is driven by the torque generating device to raise a pressure of the fluid to a high pressure fluid, and delivers the high pressure fluid to the high pressure fluid delivery mechanism by way of the outlet.

31 Claims, 4 Drawing Sheets

U.S. PATENT DOCUMENTS

| | | | |
|---|---|---|---|
| 5,071,069 | A | 12/1991 | Stirm |
| 5,148,992 | A | 9/1992 | Morrow |
| 5,169,068 | A | 12/1992 | Bertolini |
| D334,972 | S | 4/1993 | Berfield et al. |
| 5,221,193 | A | 6/1993 | Stougaard |
| 5,230,368 | A | 7/1993 | Berfield |
| 5,230,471 | A | 7/1993 | Berfield |
| D347,261 | S | 5/1994 | Berfield et al. |
| 5,338,162 | A | 8/1994 | Krarup |
| 5,395,052 | A | 3/1995 | Schneider et al. |
| 5,421,520 | A | 6/1995 | Simonette et al. |
| D381,481 | S | 7/1997 | Medema et al. |
| 5,669,558 | A | 9/1997 | Ichel |
| 5,671,887 | A | 9/1997 | Iavarone |
| 5,709,317 | A | 1/1998 | Bertram et al. |
| 5,735,461 | A | 4/1998 | Winther |
| 5,816,499 | A | 10/1998 | Christiansen |
| 6,062,486 | A | 5/2000 | Hill |
| 6,435,424 | B1 | 8/2002 | Pauley et al. |
| 6,508,386 | B2 | 1/2003 | Magri |
| 6,905,080 | B2 | 6/2005 | Pohorecki |
| 6,929,198 | B2 | 8/2005 | Dexter |
| D519,693 | S | 4/2006 | Ricker et al. |
| 7,059,305 | B2 | 6/2006 | Knaggs et al. |
| D524,999 | S | 7/2006 | Ray |
| 7,178,740 | B2 | 2/2007 | Williams |
| D542,373 | S | 5/2007 | Cooper |
| D560,046 | S | 1/2008 | Renner |
| D563,503 | S | 3/2008 | Monk |
| D567,458 | S | 4/2008 | Jiang |
| D571,434 | S | 6/2008 | Renner |
| 2005/0205688 | A1 | 9/2005 | Bennett et al. |
| 2006/0147641 | A1 | 7/2006 | Nissinen et al. |
| 2007/0060952 | A1 | 3/2007 | Roby et al. |

FOREIGN PATENT DOCUMENTS

| | | | |
|---|---|---|---|
| EP | 0312862 | A2 | 4/1989 |
| EP | 0420473 | A1 | 3/1991 |
| EP | 0464229 | A1 | 1/1992 |
| EP | 0468082 | A1 | 1/1992 |
| EP | 0521520 | A1 | 1/1993 |
| EP | 0620766 | A1 | 10/1994 |
| EP | 0606302 | B1 | 9/1995 |
| EP | 1554049 | B1 | 11/2006 |
| GB | 2407848 | A | 11/2005 |
| JP | 57059653 | A2 | 4/1982 |
| JP | 11300237 | A | 11/1999 |
| WO | 8301186 | A1 | 4/1983 |

OTHER PUBLICATIONS

Materials of KEW Hobby 70 hand held pressure washer, dated Jan. 1992.

Photo of MAC hand held pressure washer, date unknown.

PORTABLE PRESSURE WASHER SYSTEM

CROSS-REFERENCE TO RELATED APPLICATION

This application claims priority to U.S. Provisional Patent Application No. 61/048,014, filed Apr. 25, 2008, the entire contents of which is hereby incorporated by reference herein.

BACKGROUND

The present invention relates to a pressure washer system for providing a continuous spray of relatively high pressure fluid upon a surface to be cleaned. Pressure washers receive a continuous flow of fluid, raise the pressure of the fluid with an internal pump, and include an output structure to direct the high pressure fluid toward the surface to be cleaned. Current pressure washers are often bulky and difficult to effectively and efficiently transport between work areas or within a large work area.

SUMMARY

In one aspect, the invention provides a portable pressure washer system including a frame having at least one strap configured such that the frame is supported by a user by way of the at least one strap. A torque generating device is supported by the frame and has an output shaft. A pump is selectively coupled to the output shaft to receive a torque generated by the torque generating device. The pump includes an inlet for connecting to a remote fluid source and an outlet for connecting to a high pressure fluid delivery mechanism. The pump receives a fluid from the remote fluid source by way of the inlet, is driven by the torque generating device to raise a pressure of the fluid to a high pressure fluid, and delivers the high pressure fluid to the high pressure fluid delivery mechanism by way of the outlet.

In another aspect, the invention provides a portable pressure washer system having a frame. The portable pressure washer includes a torque generating device, a pump, a fluid delivery mechanism and a speed control device. The torque generating device is supported by the frame and has an output shaft. The pump is coupled to the output shaft to receive a torque generated by the torque generating device, the pump having an outlet and an inlet configured to be connected to a fluid source. The fluid delivery mechanism is coupled to the outlet, the fluid delivery mechanism having an actuator mounted thereto for controlling a flow of fluid from the fluid delivery mechanism. The speed control device controls a speed of the torque generating device and is controlled remotely by the actuator such that the speed of the torque generating device is altered as the actuator is altered.

In yet another aspect, the invention provides a portable pressure washer system including a torque generating device, a pump, a clutch and a speed control device. The torque generating device has an output shaft. The pump is selectively coupled to the output shaft to selectively receive a torque generated by the torque generating device, the pump having an outlet and an inlet configured to be connected to a fluid source. The clutch is mechanically disposed between the torque generating device and the pump. The clutch transfers torque to the pump when the output shaft rotates above a predetermined speed. The speed control device is for controlling a speed of the torque generating device and is biased to an idle condition to sustain operation of the torque generating device. When the speed control device is in the idle condition, the torque generating device operates at a speed less than the predetermined speed.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

DETAILED DESCRIPTION

Figure 1:
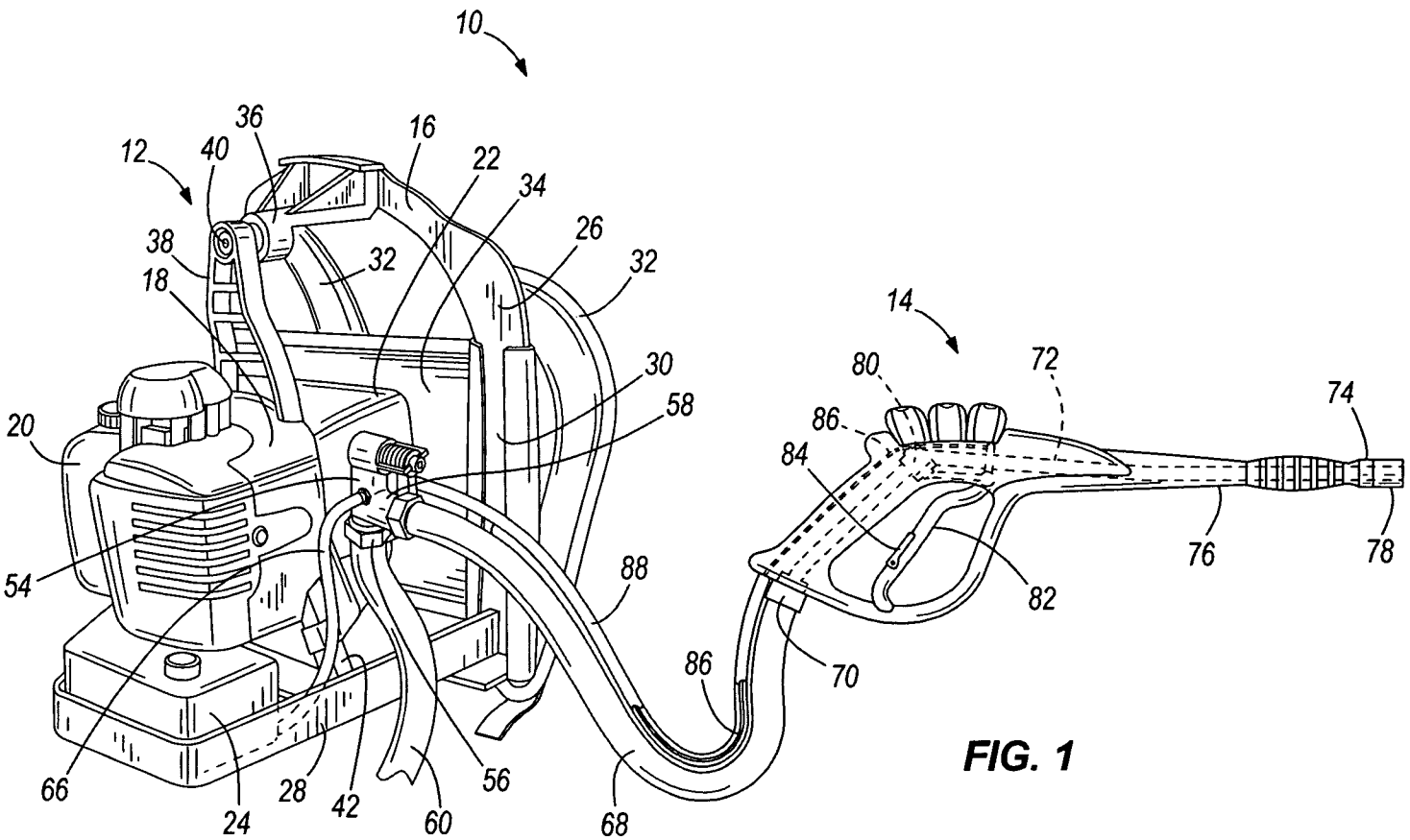
FIG. 1 is a perspective view of a portable pressure washer system according to one construction of the invention.

FIG. 1 illustrates a pressure washer system 10 including a pressure washer 12 and a single-flow spray gun 14 configured to deliver a high pressure fluid from the pressure washer 12. The pressure washer 12 has a frame 16 that supports components of the pressure washer 12 and is configured to be portably carried upon a back of a user. Components of the pressure washer 12 include an engine 18, a fuel tank 20, a pump 22 and a cleaning solution tank 24. These components will be described in greater detail below.

With further reference to FIG. 1, the frame 16 includes a vertical component 26 and a horizontal component 28 (as the pressure washer 12 is oriented in FIG. 1). The vertical component 26 includes two frame members 30, one of which is not visible in the perspective shown in FIG. 1, but is opposite and symmetrical to the frame member 30 shown. Two shoulder straps 32 are coupled to the frame members 30, respectively. The shoulder straps 32 are configured to receive a user's shoulders such that the user's shoulders support the pressure washer 12. A back pad 34 is coupled to the frame members 30 and extends between the frame members 30. The back pad 34 is configured to engage the user's back to provide comfort and to isolate the user's back from the components of the pressure washer 12 and the vibrations associated therewith. In other constructions, a single shoulder strap may be employed. In yet other constructions, other straps or connection devices such as waist straps and the like may be employed such that the pressure washer 12 is configured to be supported by a user's body.

The vertical component 26 of the frame 16 also includes a top support member 36 that extends outwardly from the vertical component 26 and away from the shoulder straps 32. The top support member 36 is configured to support the engine 18 from the top. A support arm 38 extends generally upwardly from a top of the engine 18 and is configured to be coupled to the top support member 36. In the illustrated construction, a pin 40 is used to couple the support arm 38 of the engine 18 to the top support member 36 of the frame 16. In other constructions, other suitable fasteners and configurations may be employed to couple the engine 18 to the frame 16.

The horizontal component 28 of the frame 16 extends generally outwardly and perpendicularly from a bottom of the vertical component 30 of the frame 16 and is configured to support the cleaning solution tank 24, the engine 18, and the pump 22 and the fuel tank 20, which are coupled to the engine 18. The engine 18 includes two legs 42, one of which is not visible in the perspective of FIG. 1, but is opposite and symmetrical to the leg 42 shown. The legs 42 extend between the engine 18 and the horizontal component 28 of the frame 16 such that the horizontal component 28 supports the engine 18 from a bottom of the engine 18. The pump 22 and the fuel tank 20 are coupled to the engine 18 and are thus supported by the engine 18 and the frame 16 similarly. The cleaning solution tank 24 is coupled directly to the horizontal component 28 of the frame 16. In other constructions, the tank 24 may be coupled elsewhere on the frame 16.

Figure 2:
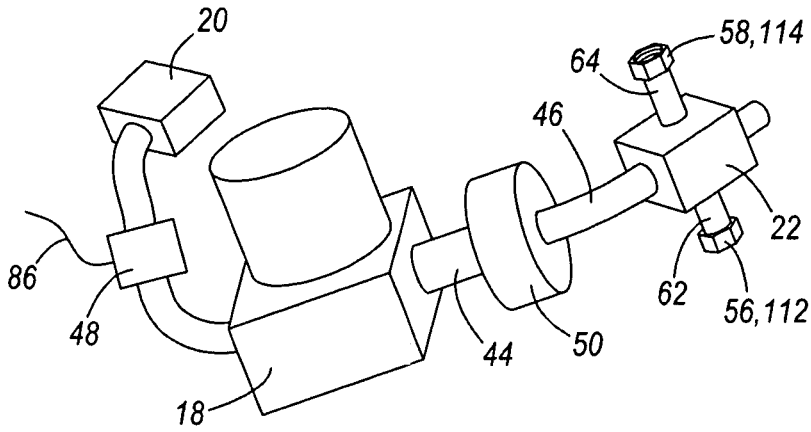
FIG. 2 is a schematic view of an engine, clutch, and pump of the pressure washer shown in FIG. 1.

As shown in FIGS. 1 and 2, the engine 18, such as an internal combustion engine, drives the pump 22 and is supported by the frame 16 of the pressure washer 12 as described above. The engine 18 includes the fuel tank 20 and an engine output shaft 44, which is selectively coupled to a pump input shaft 46 to transfer the torque generated by the engine 18 to the pump 22. The engine 18 includes a throttle having a throttle valve 48 (shown schematically in FIG. 2), that selectively allows, prevents, or alters an amount of fuel from the fuel tank 20 entering the engine 18. The speed and related operational characteristics of the engine 18 are therefore changed upon operation of the throttle valve 48. In other constructions, the engine 18 could be another suitable type of torque generating device and the throttle and throttle valve 48 could be another suitable type of speed controlling device.

In the illustrated construction, the output shaft 44 of the engine 18 is mechanically coupled to input shaft 46 of the pump 22 by way of a clutch 50 disposed therebetween. The clutch 50 is preferably a centrifugal clutch that allows selective meshing and torque transfer between the engine output shaft 44 and the pump input shaft 46. The clutch 50 is configured to allow the output shaft 44 of the engine 18 to transfer torque to the pump 22 when the engine output shaft 44 rotates at or above a predetermined speed. Further, the clutch 50 is configured to disengage the engine 18 and the pump 22 when the engine output shaft 44 slows below the predetermined speed. The speed for engagement and disengagement of the clutch 50 may depend on the operational characteristics of the pump 22, as well as a lowest desired fluid flow rate through a discharge line of the pump 22. Thus, the engine 18 is capable of entering an idle condition in which the engine 18 maintains a low speed necessary to maintain operation of the engine and below the predetermined speed. When the engine 18 is in the idle condition, the engine output shaft 44 and the pump input shaft 46 are not coupled by the clutch 50. In other constructions, a different type of clutch may be employed that allows selective meshing and torque transfer between the engine output shaft 44 and the pump input shaft 46 when the engine output shaft 44 rotates at or above a predetermined speed.

The pump 22 is coupled to a pump manifold 54 having an inlet connector 56 and an outlet connector 58. The inlet connector 56 is configured to receive a fluid supply line 60, such as a garden hose or a similar liquid flow apparatus delivering fluid from a remote fluid source, such as a municipal or local water source. In other constructions, the inlet connector 56 could receive a fluid supply line from a liquid storage tank. The outlet connector 58 is configured to be coupled to the spray gun 14, or other fluid delivery device in other constructions, to communicate the high pressure fluid from the pressure washer 12 to the spray gun 14.

Referring to FIGS. 1 and 2, the pump 22 of the pressure washer 12 includes a suction line 62 fluidly connected to the inlet connector 56 to receive a continuous flow of fluid therefrom. The pump 22 includes a discharge line 64 fluidly connected to the outlet connector 58, whereby the pump 22, via the discharge line 64, provides a continuous or pulsatingly continuous flow of relatively high pressure fluid to the outlet connector 58.

The tank 24 containing cleaning solution is supported by the frame 16, as described above, and is in fluid communication with a flow conduit 66. The flow conduit 66 is fluidly connected with a flow path in the pump manifold 54 that is downstream of the pump 22 and upstream of the outlet connector 58. For example, the conduit 66 is fluidly connected to the discharge line 64. A venturi creates a vacuum that drags cleaning solution into the fluid flowing through the pump discharge line 64 due to a pressure drop across the venturi. In other constructions, the flow conduit 66 may be fluidly connected upstream of the pump 22.

The pump 22 is driven by the engine 18, as described above, and may be one of many different types of positive displacement pumps or centrifugal pumps suitable for providing relatively high pressure flows at relatively constant flow rates. In some constructions, the pump 22 may include an internal wobble plate (not shown) that is connected to the pump input shaft 46 in rotational connection with an engine output shaft 44, or, in other constructions, with a motor output shaft or other output shaft of a suitable torque producing device. While not shown, the pump 22 may additionally include a plurality of spring loaded radial pistons that are translatable within respective chambers based on the rotation of the wobble plate. The movement of each respective piston compresses fluid within the piston chamber, causing the fluid pressure within the chamber to increase. Fluid enters the respective piston chamber from the suction line 62. The piston chambers may be held shut with spring loaded check valves, which are opened when the fluid within the piston chambers exceeds the biasing force of the spring. Piping within the pump 22 directs the high pressure fluid leaving the respective piston chamber to the pump discharge line 64.

In the illustrated construction, the pump 22 is capable of providing a fluid flow rate between about 0.5 and about 5 gallons per minute (gpm), preferably between 0.75 and about 2.5 gpm, more preferably between about 1.0 and about 1.6 gpm. The fluid pump 22 also provides an outlet pressure at the pump discharge line 64 in the range between about 300 psi and about 6000 psi, and preferably between about 700 and about 3500 psi. The actual flow rate and the outlet pressure through the pump 22 is a function of an incoming flow rate, a diameter of the fluid supply line 60, a supply pressure through the fluid inlet connector 56, as well as numerous other geometrical and fluid dynamic factors.

A hose 68 is removably coupled to the outlet connector 58 of the pump 22 and to an inlet connector 70 of the spray gun 14 to receive the high pressure fluid from the pump 22 and communicate the high pressure fluid to the spray gun 14. The hose 68 is removably coupled thereto with connectors that are configured to allow for relatively high pressure flow provided from the pump 22, such as compression fittings or other structures that require external tools for connection and removal. The connectors are disposed upon the mounting portions of the hose 68, and may be quick-connect couplers, threaded connectors, or the like. In a further construction, the hose 68 is permanently coupled to one or both of the outlet connector 58 and the spray gun 14.

The spray gun 14 includes an internal conduit 72 that provides fluid communication between the inlet connector 70 and a gun outlet 74, which is located at an extended end of a wand or lance 76 of the spray gun 14. The gun outlet 74 is configured to receive a nozzle 78 thereon to cause the fluid emitted therefrom to flow in a predetermined pattern. The nozzle 78 is configured to emit a relatively high pressure spray flow and is preferably selected to provide the relatively high pressure flow upon a concentrated area for best cleaning. The internal conduit 72 includes a valve 80 for providing selective isolation (or in other constructions throttling or restriction) of fluid flow through the internal conduit 72. The valve 80 is controlled by an actuator 82, which is mechanically coupled to the valve 80. The actuator 82 may be a pistol type trigger, a lever, or the like, and is movably mounted on the spray gun 14 in an ergonomic position, which allows a user to hold the spray gun 14 with a single hand and to operate the spray gun 14 with their fingers.

In the illustrated construction of FIG. 1, the actuator 82 includes an interlock 84 that locks the actuator 82 to prevent the actuator 82 from inadvertently being operated to open the valve 80, and thereby to prevent inadvertent high pressure fluid from being released from the spray gun 14. The interlock 84 is coupled to the actuator 82 and is movable between a locked position and an unlocked position. In the locked position, the interlock 84 engages a portion of the spray gun 14 to prevent movement of the actuator 82 when a user attempts to move the actuator 82. In the unlocked position, which is shown in FIG. 1, the interlock 84 does not engage the portion of the spray gun 14 such that the actuator 82 is capable of being moved to open the valve 80. The interlock 84 requires a motion to be made, independently of a motion required to operate the actuator 82, to reach the unlocked position and thereby allow manipulation of the actuator 82 to open the valve 80. The independent motion includes moving the interlock 84 to a position in which the interlock 84 does not engage the spray gun 14 such that the actuator 82 is capable of movement to open the valve 80. In the construction of FIG. 1, the interlock 84 is unbiased and must be manipulated between the locked and unlocked positions, as desired.

In the illustrated construction, the actuator 82 is mechanically connected to the throttle valve 48 such that motion of the actuator 82 causes related motion of the throttle valve 48 to alter the amount of fuel that flows to the engine 18 as a user manipulates the actuator 82. The throttle valve 48 is described as being remotely controlled by the actuator 82 because the actuator 82 is remote from the engine 18. The throttle valve 48 is configured to be biased to an idle position, corresponding to the idle condition of the engine 18 described above, where only a sufficient amount of fuel to sustain engine operation is provided to the engine 18.

As shown in FIG. 1, the actuator 82 is connected to the throttle valve 48 with a mechanical control apparatus 86, such as a pull wire, a linkage, or the like. In the illustrated construction of FIG. 1 a pull wire 86 is employed, similar to those found in bicycle brake systems. Depression or actuation of the actuator 82 (e.g., motion that causes the valve 80 to open) causes pulling on the wire 86, which causes a portion of the throttle valve 48 (or a member mounted to the throttle valve 48) to be similarly pulled. The throttle valve 48 is thereby repositioned from the idle position to a working position to allow additional fuel to the engine 18 from the attached fuel tank 20. The actuator 82 and the throttle valve 48 are each biased toward the idle position such that the throttle valve 48 returns to the idle position when the tension on the pull wire 86 is released. In a further construction, the actuator 82 is electrically connected to the throttle valve by an electrical control apparatus 48 such that motion, or depression, of the actuator sends an electrical signal to the throttle valve 48 to initiate operation of the valve 48. In this construction, an electrical system, such as a motor operated valve, solenoid valve, or the like, may be employed in place of the mechanical control apparatus 86.

In the construction of FIG. 1, the pull wire 86 is retained within a sheath 88 that is adjacent to the hose 68. The sheath 88 encloses the wire 86 to prevent the wire 86 from being damaged during use (and similarly prevents the wire 86 from damaging proximate objects thereto). The motion of the wire 86 is additionally constrained by the sheath 88, which retains tension within the wire 86, irrespective of an orientation of the hose 68. The hose 68 and the sheath 88 are positioned adjacent to each other such that a respective length of each are generally aligned.

Figure 4:
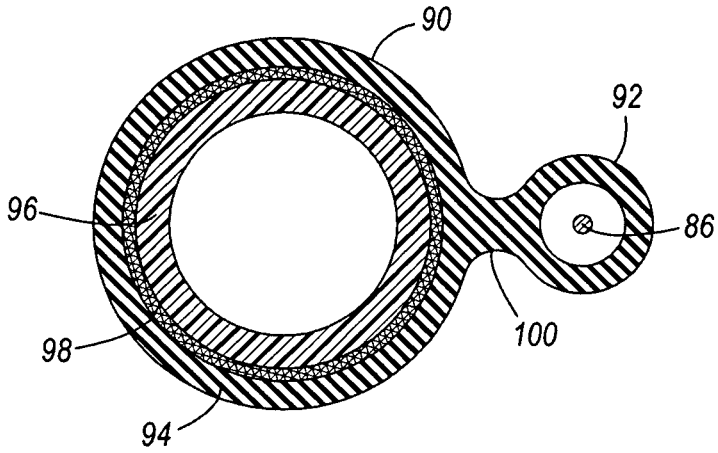
FIG. 4 is a sectional view of a hose and sheath according to an alternate construction of the portable pressure washer of FIG. 1.

FIG. 4 illustrates a cross-section of an alternative construction of a hose 90 and a sheath 92 in which the sheath 92 is integrally or monolithically formed with the hose 90, as will be described in greater detail below. In another construction, the sheath and the hose are integrally fixed together with an adhesive. In still another construction, the sheath includes a radially outward extending key or spline formed along its length that can be slid into a corresponding keyway formed along the length of the hose to integrally connect the sheath and the hose (and prevent relative motion, other than sliding) therebetween. One or more mechanical connectors may be disposed on the sheath and hose to prevent relative sliding motion therebetween.

Referring further to FIG. 4, the sheath 92 and the hose 90 are monolithically formed together with a co-extrusion process. Accordingly, the sheath 92 of FIG. 4 is formed from material that is continuous and monolithic with an outer layer 94 of the high pressure hose 90 having multiple layers. While the hose 68 and sheath 88 of FIG. 1 are formed separately, the following description of the hose 90 with respect to FIG. 4 applies to the hose 68 shown in FIG.

The hose 90 includes a flexible inner layer 96, the outer layer 94, and a braided intermediate layer 98 disposed between the inner layer 96 and the outer layer 94. The outer layer 94 of the hose 90 is connected to the sheath 92 via a central portion 100 disposed therebetween. The braided intermediate layer 98 provides adequate hoop strength to fluid pressures such as those provided by the pump 22, while minimizing the wall thickness and maintaining suitable flexibility in the hose 90. One example of a multi-layer high pressure hose monolithically formed with a co-extrusion process with a neighboring and parallel second hose or sheath having a central portion disposed therebetween is fully described in co-pending U.S. Patent Publication Number 2008/0257988, filed on Apr. 25, 2008 and titled "Dual Flow Pressure Washer," the entire contents of which is hereby incorporated by reference herein.

Figure 3:
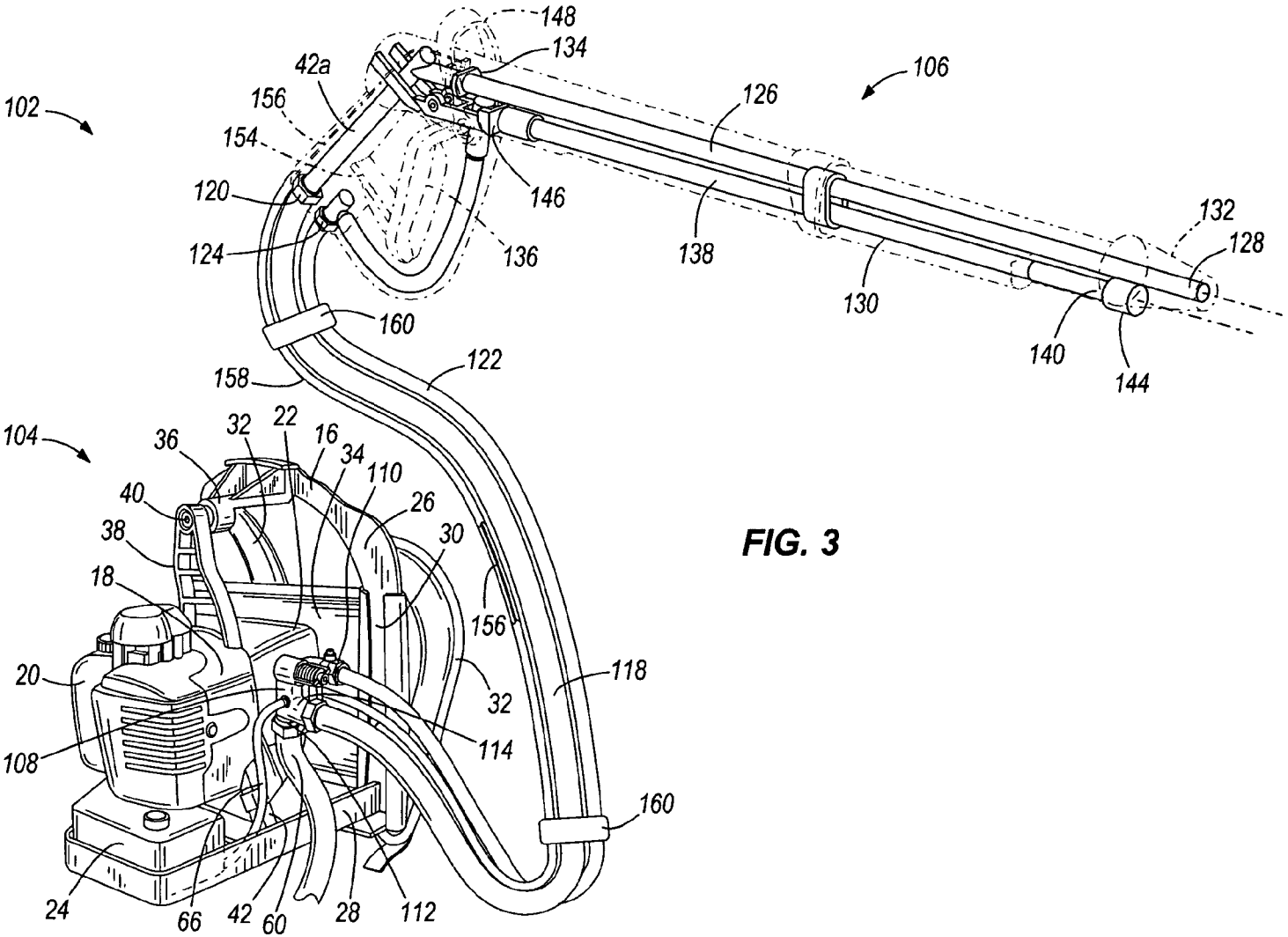
FIG. 3 is a perspective view of a portable pressure washer system according to another construction of the invention.

FIG. 3 illustrates another construction of a backpack pressure washer system 102 including a pressure washer 104 and a dual-flow spray gun 106 configured to deliver the high pressure fluid from the pressure washer 104 as well as a low pressure fluid from the remote fluid source. Most components of the pressure washer 104 are the same as the components of the pressure washer 12 of FIG. 1; therefore, like components are given the same reference numerals as FIG. 1 and are not necessarily described again.

A pump manifold 108 employed in the pressure washer 104 of FIG. 3 includes an additional outlet, i.e., a low pressure outlet 110 configured to deliver a low pressure fluid from the remote fluid source (not shown), via fluid supply line 60, that does not pass through the pump 22. The pump manifold 108 also includes an inlet connector 112 and an outlet connector 114 similar to those described above with respect to the pressure washer 12 of FIG. 1. The inlet connector 112 is configured to receive the fluid supply line 60, such as a garden hose or a similar liquid flow apparatus delivering fluid from the remote fluid source. In other constructions, the inlet connector 112 receives a fluid supply line from a liquid storage tank. The outlet connector 114 is configured to be coupled to the dual-flow spray gun 106 to communicate the high pressure fluid from the pressure washer 104 to the dual-flow spray gun 106.

The pressure washer 104 includes the cleaning solution tank 24 supported by the frame 16, as described above, the tank 24 being in fluid communication with the flow conduit 66. In the illustrated construction of FIG. 3, the flow conduit 66 is fluidly connected with a flow path in the pump manifold 108 that is downstream of the pump 22 and upstream of the outlet connector 114. A venturi creates a vacuum that drags cleaning solution into the fluid flowing through a pump discharge line due to a pressure drop across the venturi. In other constructions, the flow conduit 66 may be fluidly connected upstream of the pump 22. In yet other constructions, the flow conduit 66 may be fluidly connected upstream or downstream of the low pressure outlet 110 to deliver the cleaning solution to the low pressure fluid. In yet another construction, the tank 66 is connected with the low pressure outlet 110 by an adjustable T-valve that allows the tank 66 to be connected to one of the high or low pressure lines at a time.

A high pressure conduit, such as a high pressure hose 118 is removably coupled to the outlet connector 114 of the pump 22 and to a first inlet connector 120 of the dual-flow spray gun 106 to receive the high pressure fluid from the pump 22 and communicate the high pressure fluid to the dual-flow spray gun 106. The hose 118 is removably coupled thereto with connectors that are configured to allow for relatively high pressure flow provided from the pump 22, such as compression fittings or other structures that require external tools for connection and removal. The connectors are disposed upon the mounting portions of the hose 118, and may be quick-connect couplers, threaded connectors, or the like. In a further construction, the hose 118 is permanently coupled to one or both of the outlet connector 114 and the dual-flow spray gun 106.

A low pressure conduit, such as a low pressure hose 122 is removably coupled to the low pressure outlet 110 of the pump 22 and to a second inlet connector 124 of the dual-flow spray gun 106. The low pressure outlet 110 includes a connector, such as a low pressure rated male quick connect coupler, a male threaded connector, a snap fit connector, or the like to removably and fluidly couple to the low pressure hose 122. In another construction, the low pressure hose 122 may be permanently mounted (or semi-permanently mounted with compression fittings or other structures requiring external tools to connect and release) to the low pressure outlet 110 as well as the second inlet connector 124 of the dual-flow spray gun 106.

The dual-flow spray gun 106 includes a first internal conduit 126 that provides fluid communication between the first inlet connector 120 and a high pressure gun outlet 128, which is located at an extended end of a wand or lance 130 of the dual-flow spray gun 106. The high pressure gun outlet 128 is configured to receive a high pressure nozzle 132 thereon (shown in phantom on FIG. 3), which will be described in greater detail below. The first internal conduit 126 includes a valve 134 for providing selective isolation (or in other constructions throttling or restriction) of fluid flow through the internal conduit 126. The valve 134 is controlled by a high pressure actuator 136 (shown in phantom in FIG. 3), which is mechanically coupled to the valve 134. The actuator 136 may be a pistol type trigger, a lever, or the like, and is movably mounted on the dual-flow spray gun 106 in an ergonomic position, which allows a user to hold the dual-flow spray gun 106 with a single hand and to operate the dual-flow spray gun 106 with their fingers.

Referring to FIG. 3, the dual-flow spray gun 106 includes a second internal conduit 138 that provides fluid communication between the second inlet connector 124 and a low pressure gun outlet 140, which is located at an extended end of the wand 130 of the dual-flow spray gun 106. The fluid available from the low pressure gun outlet 140 has substantially the same outlet pressure as fluid provided to the pressure washer 104 from the fluid supply line 60 connected thereto. The low pressure gun outlet 140 is configured to receive a low pressure nozzle 144 thereon, which will be described in greater detail below. The second internal conduit 138 includes a second valve 146 for selectively isolating the fluid flow through the low pressure outlet 140 of the spray gun 106, and therefore flow through the low pressure hose 122. The second valve 146 is mechanically connected to a low pressure actuator 148, such as a trigger, switch, lever, or the like (shown in phantom in FIG. 3). The low pressure actuator 148 is operable to prevent flow through the second internal conduit 138 and ultimately out of the low pressure outlet 140. In the illustrated construction, the high and low pressure outlets 128, 140 of the dual-flow spray gun 106 are coupled together and contained within the wand 130, which is a dual conduit wand. In a further construction, the high and low pressure outlets 128, 140 are contained within two independent wands. The use of the two outlets 128, 140 provides for simultaneous fluid outlet flow from the spray gun 106, at both a relatively high pressure from the pump outlet connector 114 and a relatively low pressure from the fluid supply line 60. In a further construction, the outlet conduits 128, 140 may be connected directly with the spray gun 106.

Figure 6:
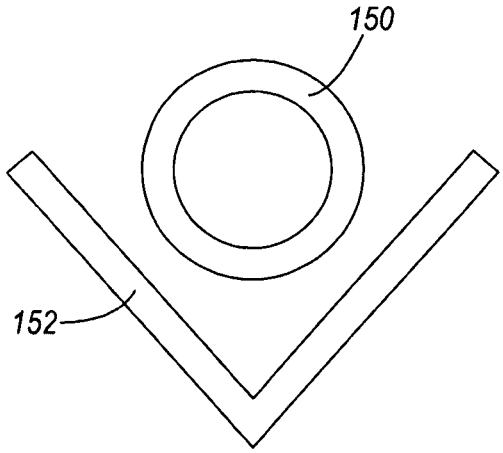
FIG. 6 is a schematic view of a flow pattern provided by the pressure washer of FIG. 3.

The high and low pressure gun outlets 128, 140 are configured to receive the high and low pressure nozzles 132, 144, respectively, thereon to cause the fluid emitted therefrom to flow in a predetermined pattern. In the illustrated constructions, the high pressure nozzle 132 is configured to emit a relatively high pressure spray flow, while the low pressure nozzle 144 is configured to emit a relatively low pressure flow. The high pressure nozzle 132 may be selected to provide the relatively high pressure flow upon a concentrated area for best cleaning, and the low pressure nozzle 144 may be selected to provide a wide flow that surrounds a large portion of the flow from the high pressure nozzle 132 to effectively flush the dirt and debris removed by the high pressure fluid from the high pressure nozzle 132. For example, as shown schematically in FIG. 6, the high pressure nozzle 132 provides a cylindrical spray flow pattern 150, and the low pressure nozzle 144 provides a V-shaped flow pattern 152, which surrounds a portion of the area being impacted by the fluid from the high pressure nozzle 132 (at least half in the illustrated construction). These relative flow patterns allow for effective flushing regardless of the position of the dual-flow spray gun 106, and without requiring extensive side to side or up and down motion of the spray gun 106 by a user.

The low pressure nozzle 144 may be formed with two slots defined upon the face thereof, each slot including an end portion that is proximate or intersecting an end portion of the opposite slot. The planar fan fluid pattern from each slot intersects while leaving, or soon after leaving the low pressure nozzle 144, causing the fluid spray from the low pressure nozzle 144 to interact with a large surface area, regardless of the position of the spray gun 106 with respect to the surface. Several constructions of a V-shaped nozzle are disclosed in co-pending U.S. patent application Ser. No. 12/429,357, filed on Apr. 24, 2009 and titled "Nozzle For Use With A Pressure Washer", the entire contents of which is hereby incorporated by reference herein.

The dual-flow spray gun 106 of FIG. 3 includes the high pressure actuator 136 and the low pressure actuator 148. The low pressure actuator 148 is configured for pivotal movement between an actuated position in which the second valve 146 is open to allow fluid to flow from the low pressure gun outlet 140, and non-actuated position in which the second valve 146 is closed to prevent fluid from flowing from the low pressure gun outlet 140.

The high pressure actuator 136 is similar to the actuator 82 described above with respect to the single-flow spray gun 14. However, the high pressure actuator 136 includes an interlock 154 (shown in phantom in FIG. 3) that locks the actuator 136 to prevent the actuator 136 from inadvertently being operated to open the first valve 134, and thereby to prevent inadvertent high pressure fluid from being released from the dual-flow spray gun 106. The interlock 154 is coupled to the high pressure actuator 136 and is movable between a locked position and an unlocked position. In the locked position, which is shown in FIG. 3, the interlock 154 engages a portion of the dual-flow spray gun 106 to prevent movement of the high pressure actuator 136 when a user attempts to move the actuator 136. In the unlocked position, the interlock 154 does not engage the portion of the dual-flow spray gun 106, such that the high pressure actuator 136 is capable of being moved to open the first valve 134. The interlock 154 requires a motion to be made, independently of a motion required to operate the high pressure actuator 136, to reach the unlocked position to allow the actuator 136 to be capable of manipulation to open the first valve 134. The independent motion includes moving the interlock 154 to a position in which the interlock 154 does not engage the dual-flow spray gun 106 such that the high pressure actuator 136 is capable of movement to open the first valve 134. In the construction of FIG. 3, the interlock 154 is biased to the locked position, i.e., biased to engage the dual-flow spray gun 106, when the high pressure actuator 136 is not actuated. In other constructions, the interlock 154 may be configured like the interlock 84 of FIG. 1. Likewise, the interlock 84 of FIG. 1 may be configured like the interlock 154 of FIG. 3.

In the illustrated construction, the high pressure actuator 136 is mechanically connected to the throttle valve 48 such that motion of the actuator 136 causes related motion of the throttle valve 48 to alter the amount of fuel that flows to the engine 18 as a user manipulates the actuator 136. The throttle valve 48 is described as being remotely controlled by the high pressure actuator 136 because the actuator 136 is remote from the engine 18. The throttle valve 48 is configured to be biased to an idle position, corresponding to the idle condition of the engine 18 described above, where only a sufficient amount of fuel to sustain engine operation is provided to the engine 18.

As shown in FIG. 3, the high pressure actuator 136 is connected to the throttle valve 48 with a mechanical control apparatus 156 such as a pull wire, a linkage, or the like. In the construction of FIG. 3, a pull wire 156 is employed, similar to those found in bicycle brake systems. Depression or actuation of the high pressure actuator 136 (e.g., motion that causes the valve 134 to open) causes pulling on the wire 156, which causes a portion of the throttle valve 48 (or a member mounted to the throttle valve 48) to be similarly pulled. The throttle valve 48 is thereby repositioned from the idle position to a working position to allow additional fuel to the engine 18 from the attached fuel tank 20. The high pressure actuator 136 and the throttle valve 48 are each biased toward the idle position such that the throttle valve 48 returns to the idle position when the tension on the pull wire 156 is released. In a further construction, the high pressure actuator 136 is electrically connected to the throttle valve 48 such that motion, or depression, of the actuator sends an electrical signal to the throttle valve 48 to initiate operation of the valve 48. In this construction, an electrical system, such as a motor operated valve, solenoid valve, or the like, may be employed in place of the wire 156.

In the construction of FIG. 3, the pull wire 156 is retained within a sheath 158 that is adjacent to the high pressure hose 118 and the low pressure hose 122. The sheath 158 encloses the wire 156 to prevent the wire 156 from being damaged during use (and similarly prevents the wire 156 from damaging proximate objects thereto). The motion of the wire 156 is additionally constrained by the sheath 158, which retains tension within the wire 156, irrespective of an orientation of the high pressure hose 118 or the low pressure hose 122.

As illustrated in FIG. 3, the sheath 156, the high pressure hose 118 and the low pressure hose 122 are formed separately. Connectors or fasteners 160 are disposed at one or more locations on the sheath 156, the high pressure hose 118 and the low pressure hose 122 to at least partially fix the sheath 156, the high pressure hose 118 and the low pressure hose 122 together.

Figure 5:
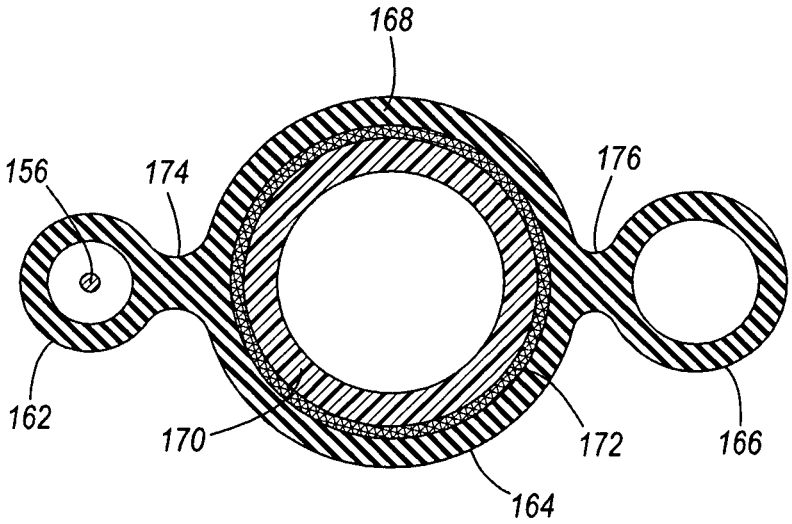
FIG. 5 is a sectional view of two hoses and a sheath according to an alternate construction of the portable pressure washer of FIG. 3.

FIG. 5 illustrates a cross-section of an alternative construction of a sheath 162, a high pressure hose 164 and a low pressure hose 166 of the pressure washer 104 (FIG. 3) in which the sheath 162 is integrally or monolithically formed with each of the high and low pressure hoses 164, 166. Referring to the construction of FIG. 5, the high pressure hose 164 and the low pressure hose 166 are monolithically formed using a co-extrusion process similar to the process discussed above with respect to the single-flow spray gun 14. The high pressure hose 164 and the low pressure hose 166 are additionally monolithically formed with the sheath 162. The sheath 162 is formed from material that is continuous and monolithic with an outer layer 168 of the high pressure hose 164 having multiple layers.

While the sheath 158, high pressure hose 118 and low pressure hose 122 of FIG. 3 are formed separately, the following description of the high pressure hose 164 with respect to FIG. 5 applies to the high pressure hose 118 shown in FIG. 3. Referring to FIG. 5, the high pressure hose 164 includes a flexible inner layer 170, the outer layer 168, and a braided intermediate layer 172 disposed between the inner layer 170 and the outer layer 168. The outer layer 168 of the hose 164 is connected to the sheath 162 via a central portion 174 disposed therebetween, formed monolithically with the outer layer 168 of the hose 164 and the sheath 162. Further, the outer layer 168 of the hose 164 is connected to the hose 166 via a central portion 176 disposed therebetween, which is also formed monolithically with the outer layer 168 of the hose 164 as well as the hose 166. The braided intermediate layer 172 provides adequate hoop strength to fluid pressures such as those provided by the pump 22, while minimizing the wall thickness and maintaining suitable flexibility in the high pressure hose 164. One example of a multi-layer high pressure hose monolithically formed with a co-extrusion process with a neighboring and parallel second hose or sheath having a central portion disposed therebetween is fully described in co-pending U.S. Patent Publication Number 2008/0257988, filed on Apr. 25, 2008 and titled "Dual Flow Pressure Washer," as was described above with respect to the single-flow spray gun 14 of FIG. 1.

In other constructions, the sheath 158 may be formed separately from and coupled to the hoses 118, 122 (or upon a central portion when provided), using fasteners, adhesive, a keying structure, or the like. In another construction, one or more of the sheath 158, the high pressure hose 118 and the low pressure hose 122 are integrally fixed together with an adhesive or other suitable mechanical structure. In still another construction, one or more of the sheath 158, the high pressure hose 118 and the low pressure hose 122 includes a radially outward extending key or spline formed along its length that can be slid into a corresponding keyway formed along the length of the other(s) of the sheath 158, the high pressure hose 118 and the low pressure hose 122 to integrally connect the sheath 158, the high pressure hose 118 and the low pressure hose 122 and prevent relative motion, other than sliding, therebetween. One or more mechanical connectors may be disposed on the sheath 158, the high pressure hose 118 and the low pressure hose 122 to prevent relative sliding motion therebetween.

In other constructions of the pressure washer systems 10 and 102, the pump 22 may be operated by a torque generating device such as an electric motor instead of an engine having a throttle. The electric motor receives electrical current from a remote power source connected thereto, or from a battery pack coupled to the pressure washer 12, 104. In such constructions, the electric motor is coupled to the pump and does not idle. Instead of a mechanical control apparatus, the remote control apparatus includes a sensor in fluid communication with the pump discharge line. The sensor monitors a fluid parameter, such as fluid pressure, rate of change of fluid pressure, or fluid flow rate. In one construction, the sensor is a pressure sensor that provides a signal (either logic, analog, or digital) representative of a sensed fluid pressure. The electric motor includes a controller (i.e., a speed control device in place of a throttle) that prevents current flow to the electric motor when the signal indicates a pressure above a predetermined level (indicating an isolated fluid flow path downstream of the pump discharge line 64). The controller automatically resets when sensed pressure drops below the predetermined level (thereby restarting the motor), or the controller may require user interaction to reset.

In operation, a user actuates the high pressure actuator 82, 136 when high pressure fluid from the high pressure outlet connector 58, 114 is desired. Actuation of the actuator 82, 136 moves the wire 86, 156, which alters the position of the throttle valve 48 to increase the amount of fuel delivered to the engine 18. Correspondingly, the wire 86, 156 alters the position of the throttle valve 48 to decrease the amount of fuel delivered to the engine 18 when less high pressure fluid is desired (i.e., the actuator 82, 136 is released). When the high pressure actuator 82, 136 is not actuated, the throttle valve 48 is positioned to place the engine 18 in the idle condition, in which the pump 22 and engine 18 are disengaged by the clutch 50. This reduces noise experienced by the user during periods when the spray gun 14, 106 is not actuated, reduces the amount of heat generated by the engine 18, extends engine life, saves fuel and reduces cost.

Thus, the invention provides, among other things, a portable backpack pressure washer that delivers a high pressure fluid from a remote fluid source, a pressure washer having an engine throttle controlled by a gun actuator, and a pressure washer having a clutch and speed control device that places the pressure washer in an idle condition when there is no demand for a high pressure fluid.

Various features and advantages of the invention are set forth in the following claims.

What is claimed:

1. A portable pressure washer system comprising:

a frame having at least one strap configured such that the frame is supported by a user by way of the at least one strap;

a torque generating device supported by the frame and having an output shaft; and a pump supported by the frame and selectively coupled to the output shaft to receive a torque generated by the torque generating device, the pump including an inlet for connecting to a remote fluid source and an outlet;

a high pressure fluid delivery mechanism in fluid communication with the outlet, the high pressure fluid delivery mechanism being moveable relative to the frame, wherein the pump receives a fluid from the remote fluid source by way of the inlet, is driven by the torque generating device to raise a pressure of the fluid to a high pressure fluid, and delivers the high pressure fluid to the high pressure fluid delivery mechanism by way of the outlet.

2. The portable pressure washer system of claim 1, wherein the frame includes a first component and a second component positioned substantially perpendicular to the first component, and wherein the at least one strap is coupled to the first component.

3. The portable pressure washer system of claim 2, wherein the torque generating device is supported at least partially by the first component of the frame.

4. The portable pressure washer system of claim 3, wherein the torque generating device is supported at least partially by the second component of the frame.

5. The portable pressure washer system of claim 1, further comprising a clutch mechanically disposed between the torque generating device and the pump, wherein the clutch transfers torque to the pump when the output shaft rotates above a predetermined speed.

6. The portable pressure washer system of claim 5, wherein the clutch includes a centrifugal clutch.

7. The portable pressure washer system of claim 1, further comprising:

a first fluid conduit disposed between the outlet and the fluid delivery mechanism;

a first actuator coupled to the fluid delivery mechanism for controlling high pressure fluid flow through the first conduit and from the fluid delivery mechanism;

a second fluid conduit disposed between the remote fluid source and the fluid delivery mechanism for controlling a low pressure fluid flow through the second conduit and from the fluid delivery mechanism.

8. The portable pressure washer system of claim 1, wherein the at least one strap includes a shoulder strap.

9. The portable pressure washer system of claim 1, further comprising:

an actuator coupled to the fluid delivery mechanism for controlling fluid flow from the fluid delivery mechanism; and a speed controlling device for selectively controlling a speed of the torque generating device, wherein the speed controlling device is controlled remotely by the actuator such that the speed of the torque generating device is altered as the actuator is altered.

10. The portable pressure washer system of claim 9, wherein the speed controlling device is biased to an idle condition to sustain operation of the torque generating device, the pressure washer further comprises a clutch mechanically disposed between the torque generating device and the pump, wherein the clutch transfers torque to the pump when the output shaft rotates above a predetermined speed, and further wherein when the speed controlling device is in the idle condition, the torque generating device operates at a speed less than the predetermined speed.

11. The portable pressure washer system of claim 10, further comprising: a first fluid conduit disposed between the outlet and the fluid delivery mechanism, wherein the actuator is a first actuator that controls the flow of fluid through the first conduit; a second fluid conduit disposed between the fluid source and the fluid delivery mechanism; and a second actuator in fluid communication with the second fluid conduit to selectively control a flow of fluid through the second conduit.

12. The portable pressure washer system of claim 9, further comprising a valve mechanically connected to the actuator for controlling fluid flow through the fluid delivery mechanism, wherein motion of the actuator controls a position of the valve.

13. The portable pressure washer system of claim 1, further comprising: a fluid conduit connecting the pump outlet to the fluid delivery mechanism; and a fluid container in fluid communication with the fluid conduit, the fluid container configured to hold a volume of cleaning solution.

14. A portable pressure washer system having a frame, the portable pressure washer system comprising:

a torque generating device supported by the frame and having an output shaft;

a pump coupled to the output shaft to receive a torque generated by the torque generating device, the pump having an outlet and an inlet configured to be connected to a fluid source;

a fluid delivery mechanism coupled to the outlet, the fluid delivery mechanism having an actuator mounted thereto for controlling a flow of fluid from the fluid delivery mechanism;

a fluid conduit connecting the pump outlet to the fluid delivery mechanism;

a fluid container in fluid communication with the fluid conduit, the fluid container configured to hold a volume of cleaning solution; and a speed control device that controls a speed of the torque generating device, wherein the speed control device is controlled remotely by the actuator such that the speed of the torque generating device is altered as the actuator is altered.

15. The portable pressure washer system of claim 14, wherein the torque generating device includes an engine and the speed control device includes a throttle valve that selectively alters an amount of fuel that enters the engine, and further wherein the throttle valve is controlled remotely by the actuator such that the amount of fuel that flows to the engine is altered as the actuator is altered.

16. The portable pressure washer system of claim 14, wherein the frame includes at least one shoulder strap.

17. The portable pressure washer system of claim 14, further comprising a centrifugal clutch mechanically disposed between the torque generating device and the pump, wherein the clutch transfers torque to the pump when the output shaft rotates above a predetermined speed.

18. The portable pressure washer system of claim 17, wherein the speed control device is biased to an idle condition to sustain operation of the torque generating device, and further wherein when the speed control device is in the idle condition, the torque generating device operates at a speed less than the predetermined speed.

19. The portable pressure washer system of claim 14, further comprising a control apparatus configured to communicate from the actuator to the speed control device dependent upon a position of the actuator, the control apparatus operatively coupled with the torque generating device to control the speed of the torque generating device.

20. The portable pressure washer system of claim 19, wherein the control apparatus includes a wire, wherein the torque generating device includes an engine, and wherein the speed control device includes a throttle valve for selectively altering an amount of fuel that enters the engine, wherein movement of the actuator is communicated to the throttle valve by way of the wire to alter a position of the throttle valve to alter the amount of fuel that enters the engine.

21. The portable pressure washer system of claim 14, further comprising:

a first fluid conduit disposed between the outlet and the fluid delivery mechanism, wherein the actuator is a first actuator that controls the flow of fluid through the first conduit;

a second fluid conduit disposed between the fluid source and the fluid delivery mechanism; and a second actuator in fluid communication with the second fluid conduit to selectively control a flow of fluid through the second conduit.

22. The portable pressure washer system of claim 14, further comprising a valve disposed between the fluid delivery mechanism and the pump for controlling fluid flow through the fluid delivery mechanism, the valve mechanically connected to the actuator such that motion of the actuator controls a position of the valve.

23. A portable pressure washer system comprising:

a torque generating device having an output shaft;

a pump selectively coupled to the output shaft to selectively receive a torque generated by the torque generating device, the pump having an outlet and an inlet configured to be connected to a fluid source;

a clutch mechanically disposed between the torque generating device and the pump, wherein the clutch transfers torque to the pump when the output shaft rotates above a predetermined speed; and a speed control device for controlling a speed of the torque generating device, the speed control device biased to an idle condition to sustain operation of the torque generating device, wherein when the speed control device is in the idle condition, the torque generating device operates at a speed less than the predetermined speed.

24. The portable pressure washer system of claim 23, further comprising a fluid delivery mechanism coupled to the outlet, the fluid delivery mechanism including an actuator mounted thereto for controlling flow of fluid from the fluid delivery mechanism.

25. The portable pressure washer system of claim 24, wherein the speed control device is controlled remotely by the actuator such that the speed of the torque generating device is altered as the actuator is altered.

26. The portable pressure washer system of claim 25, further comprising a control apparatus configured to communicate from the actuator to the speed control device dependent on a position of the actuator, the control apparatus operatively coupled with the torque generating device to control the speed of the torque generating device.

27. The portable pressure washer system of claim 26, wherein the control apparatus includes a wire, wherein the torque generating device includes an engine, and wherein the speed control device includes a throttle valve for selectively altering an amount of fuel that enters the engine, wherein movement of the actuator is communicated to the throttle valve by way of the wire to alter a position of the throttle valve to alter the amount of fuel that enters the engine.

28. The portable pressure washer system of claim 24, wherein the torque generating device includes an engine and the speed control device includes a throttle valve that selectively controls an amount of fuel that enters the engine, and further wherein the throttle valve is controlled remotely by the actuator such that the amount of fuel that flows to the engine is altered as the actuator is altered.

29. The portable pressure washer of claim 24, further comprising a valve mechanically connected to the actuator such that motion of the actuator controls the position of the valve, wherein the position of the valve controls fluid flow through the fluid delivery mechanism.

30. The portable pressure washer of claim 23, further comprising a backpack frame with at least one shoulder strap, the frame supporting the torque generating device.

31. The portable pressure washer of claim 23, further comprising:

a fluid conduit connecting the pump outlet to the fluid delivery mechanism; and a fluid container in fluid communication with the fluid conduit, the fluid container configured to hold a volume of cleaning solution.

* * * * *